United States Patent [19]

Cross

[11] 4,211,264

[45] Jul. 8, 1980

[54] LOG SPLITTER

[76] Inventor: Robert M. Cross, 8927 Greiner Dr., Houston, Tex. 77080

[21] Appl. No.: 966,118

[22] Filed: Dec. 4, 1978

[51] Int. Cl.[2] ..... B27L 7/00

[52] U.S. Cl. ..... 144/193 D; 144/193 R

[58] Field of Search ..... 144/193 R, 193 C, 193 D, 144/323; 125/23 R

[56] References Cited

U.S. PATENT DOCUMENTS 3,982,572 9/1976 Kortendick ..... 144/193 D 4,033,390 7/1977 Piontkowski ..... 144/193 D

*Primary Examiner*—Robert Louis Spruill

*Assistant Examiner*—W. D. Bray

*Attorney, Agent, or Firm*—Ranseler O. Wyatt

[57] ABSTRACT

A device for splitting logs, such as are for fireplace use, comprising a vertical post mounted on a plate, and a telescoping member slidably mounted on said post, having a wedge integral with said member, and a laterally extended plate on said member, opposite said wedge, for driving the wedge deeper into the log.

2 Claims, 2 Drawing Figures

LOG SPLITTER

BACKGROUND OF THE INVENTION

The closest reference appears to be Piontkowski, U.S. Pat. No. 4,033,390, but this reference does not teach the cylindrical member on the round pole, adjustable to the position desired with reference to the split to be made in the log, nor the rearwardly extended plate to drive the wedge into the log after it has been driven its length into the log.

SUMMARY OF THE INVENTION

A device for splitting logs consisting of a pole vertically mounted on a base plate, and a sliding member mounted on said pole having a wedge integral thereon and extending laterally therefrom, and a plate mounted on said sliding member and extending laterally therefrom, opposite said wedge.

DESCRIPTION OF THE PREFERRED EMBODIMENT

Figure 1:
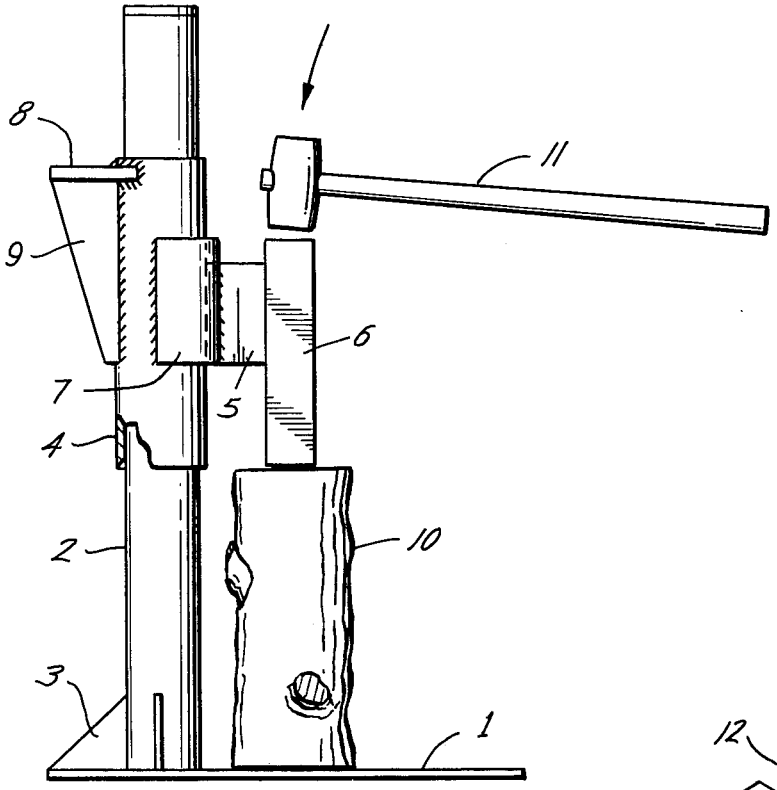
FIG. 1 is a side elevation of the device, showing a log in position to be split.
Figure 2:
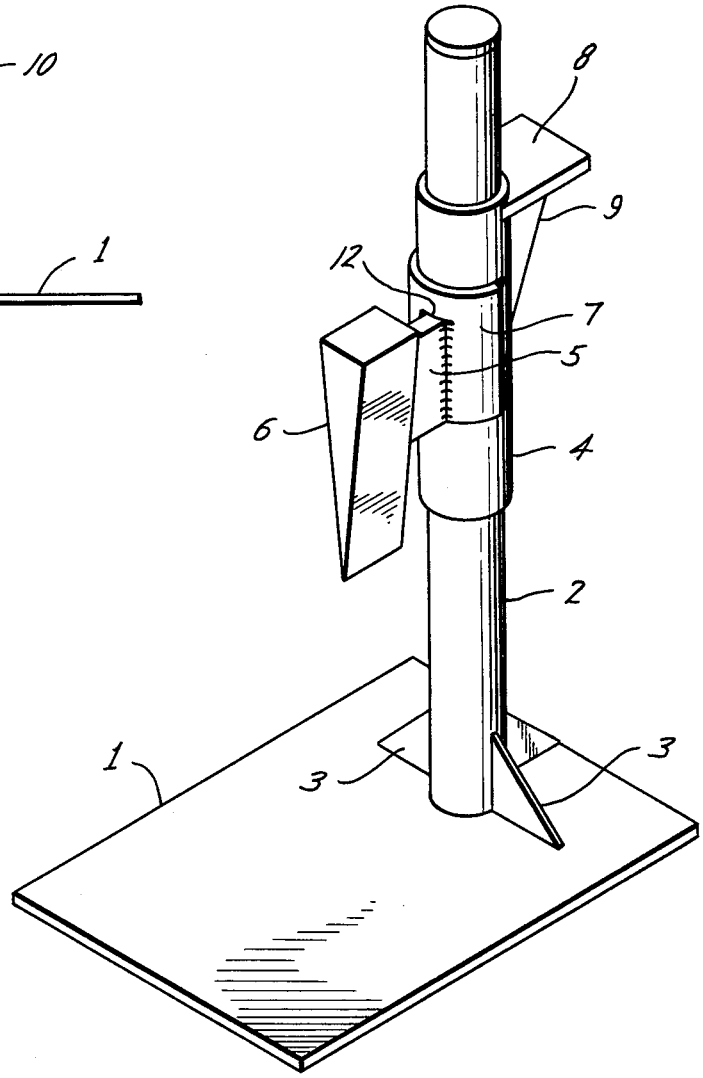
FIG. 2 is a perspective elevational view.

In the drawings, the numeral 1 designates a base plate of rigid material on which a vertical pole 2 is mounted, and is provided with angle braces 3, 3 to maintain its vertical position. A sliding member 4, being a cylinder of rigid material, is mounted on the pole 2, in a telescoping relation, being freely movable vertical and annularly on the pole 2. A wedge 6 is mounted on the member 4, by means of the plate 7, which is welded to the member 4, and the wedge 6 being integral with the plate 5, and the plate 5 being welded around all of its margins to the plate 7, the said plate 7 acting as a reinforcing member for the wedge and plate 5.

Mounted on the member 4, opposite the wedge 6, and at the top of the member 4, is the back plate 8 which has the angular support 9 welded to the member 4.

In use, the member 4 is raised manually to the desired heigth, so that the point of the wedge 6 rests on the log to be split, as 10, and the member 4 is rotated to permit the wedge to be seated at the exact place on the log where it is desired to start the split. A sledge, as 11, may then be employed to strike the necessary blows to the top of the wedge 6, driving same into the log. In the event the wedge is driven its full length into the log and the split still has not been accomplished, additional blows may be delivered to the plate 8 to complete the split. The braces 3, 3 will limit the downward movement of the member 4, so that the edge of the wedge 6 that is sharpened will not strike the base plate 1.

I claim:

1. In a log splitter having a base plate, a pole vertically mounted on said base plate, a wedge vertically movable on said pole and means on said wedge to receive blows, the improvement comprising said wedge being mounted on a cylindrical member for movement on said pole, and a plate means extending laterally from said member on the opposite side of said member from said wedge for recieving blows to complete a split.

2. In a log splitter having a base plate, a pole vertically mounted on said base plate, a wedge vertically movable on said pole and means on said wedge to receive blows, the improvement comprising said wedge being mounted on a reinforcing plate, and said reinforcing plate is mounted on a cylindrical member which is telescopically mounted on said pole, and a plate means extending laterally from said cylindrical member, opposite said wedge, adapted to receive blows to complete a split.

* * * * *